US006012912A

United States Patent [19]

Gross et al.

[11] Patent Number: 6,012,912

[45] **Date of Patent: *Jan. 11, 2000**

[54] APPARATUS FOR SPINNING A SYNTHETIC YARN

[75] Inventors: Rahim Gross; Heinz Schippers, both of Remscheid, Germany

[73] Assignee: Barmag AG, Remscheid, Germany

[ * ] Notice: This patent is subject to a terminal disclaimer.

[21] Appl. No.: 09/024,717

[22] Filed: Feb. 17, 1998

Related U.S. Application Data

[62] Division of application No. 08/684,389, Jul. 19, 1996, Pat. No. 5,783,127.

[30] Foreign Application Priority Data

| | | | |
|---|---|---|---|
| Jul. 19, 1995 | [DE] | Germany | 195 26 265 |
| Aug. 23, 1995 | [DE] | Germany | 195 30 817 |
| Nov. 16, 1995 | [DE] | Germany | 195 42 769 |

[51] Int. Cl.[7] ..... D01D 5/16; D01D 10/02

[52] U.S. Cl. ..... 425/66; 264/103; 264/210.8; 264/211.17; 425/72.2; 425/377; 425/382.2; 425/464

[58] Field of Search ..... 425/66, 72.2, 377, 425/378.2, 382.2, 464; 264/103, 210.8, 211.17

[56] References Cited

U.S. PATENT DOCUMENTS

| | | | |
|---|---|---|---|
| 2,811,409 | 10/1957 | Clapp et al. | 425/72.2 |
| 3,103,407 | 9/1963 | Clark et al. | 264/290.7 |
| 3,522,342 | 7/1970 | Nungesser et al. | 425/72.2 |
| 4,369,155 | 1/1983 | Schilo et al. | 264/103 |
| 4,877,572 | 10/1989 | Clarke et al. | 264/103 |
| 4,902,461 | 2/1990 | Schippers | 264/103 |
| 5,469,149 | 11/1995 | Binner et al. | 340/677 |
| 5,552,097 | 9/1996 | Schippers | 425/382.2 |
| 5,558,825 | 9/1996 | Ueda et al. | 264/103 |
| 5,698,146 | 12/1997 | Schippers et al. | 425/382.2 |

FOREIGN PATENT DOCUMENTS 38 23 337 1/1989 Germany .

*Primary Examiner*—Harold Pyon
*Assistant Examiner*—Joseph Leyson
*Attorney, Agent, or Firm*—Alston & Bird LLP

[57] ABSTRACT

An apparatus for spinning, drawing, and winding a synthetic filament yarn, wherein the yarn is subjected during its drawing in a draw zone to a multi-stage heat treatment by heated surfaces. In the first heat treatment, the yarn is heated to the range of the glass transition temperature of the yarn material, and the yarn is guided over the heating surface while partially looping thereabout. The second stage of the heat treatment is formed by an elongate heating surface, and at least one of the heating surfaces is heated to a surface temperature above the melt point of the yarn material. In the draw zone, the yarn is subjected to a tension, which is necessary for a plastic deformation in or directly downstream of the first stage of the heat treatment. The process performed by the apparatus causes the yarn to be drawn and set.

9 Claims, 5 Drawing Sheets

APPARATUS FOR SPINNING A SYNTHETIC YARN

This application is a divisional of application Ser. No. 08/684,389, filed Jul. 19, 1996, now U.S. Pat. No. 5,783, 127.

BACKGROUND OF THE INVENTION

The invention relates to a method and an apparatus for spinning a synthetic multi-filament yarn.

A method and apparatus of the described type is known, for example, from U.S. Pat. No. 3,103,407, wherein a freshly spun synthetic filament yarn (polyester) is advanced by means of a withdrawal roll or godet from a spin zone to a draw zone and drawn between the withdrawal roll and a draw roll or godet. In this process, the yarn is heated in two stages by contacting the heated withdrawal roll and a heated metal plate directly adjacent thereto. The withdrawal roll is heated to a temperature from 60 to 90° C. and the metal plate to a temperature from 160 to 200° C. The withdrawal speed is in a range of less than 1,000 m/min.

The above-described method has the disadvantage that the heating of the yarn is dependent exclusively on the contact between the heated surfaces and the yarn. Furthermore, the long contact length and high contact force lead to increased yarn frictions, which have disadvantageous effects on the yarn quality. These adverse effects amplify rapidly at higher withdrawal speeds, so that an even heat transfer is no longer possible.

It is an object of the present invention to achieve in the thermal treatment of an advancing synthetic multi-filament yarn, which may be polyester, polyamide, polytrimethylene terephthalate, and polypropylene, a uniform heating of the yarn with a correspondingly uniform drawing, and uniform, well adjustable yarn properties.

SUMMARY OF THE INVENTION

The above and other objects and advantages of the present invention are achieved by the provision of an apparatus which includes an extruder for extruding a polymeric melt to form a plurality of advancing filaments which are gathered to form an advancing yarn, and a drawing system for drawing the advancing yarn as it advances through a drawing zone. A heater is provided for heating the advancing yarn in the drawing zone, and the heater includes a first heater over which the yarn is guided and a second downstream heater which has an elongate heating surface and a plurality of guides for guiding the yarn along the heating surface. After the heat treatment, the advancing yarn is wound into a package.

During at least one of the first and second heat treatments, the yarn is subjected to a temperature higher than the melt point temperature of the yarn, which is at least 100 degrees C. higher than the melt point temperature of the yarn and preferably between about 200 and 300 degrees C. higher than the melt point temperature of the yarn. Also, during the drawing step, the yarn is subjected to a tension which is sufficient for the plastic deformation of the yarn during or immediately downstream of the first heating step.

The high temperature of the heat treatment causes immediately a shocklike heating of the yarn shortly after its entry into the heating zone. This allows, on the one hand, to accurately localize a so-called yield point. The yield point is a very narrow range of the yarn, in which plastic deformation starts by a uniform flow. On the other hand, the shocklike heating results preferably in structural changes. The mechanical stress on the yarn caused by friction is minimized, so that the yarn tension, which is necessary for the plastic deformation, follows a constant course.

A special advantage is that a continuous drawing and setting do not require an increase in the yarn tension, but that same may remain substantially constant. The shocklike heat treatment, along with the draw tension, allows to realize already an adequately satisfactory setting effect. A further advantage is that it is possible to omit means, such as, for example godets, for increasing the yarn tension between the individual stages of the heat treatment.

A variant of the method includes increasing the yarn tension within the draw zone, which may be used advantageously for processing materials, such as, for example, polypropylene, which require a subsequent drawing.

The first heat treatment may include guiding the advancing yarn over a first heating surface which has a surface temperature above the melt point of the yarn material. This embodiment has the advantage that the heat treatment in the first stage may occur, in particular, by a heated draw pin, so that despite a small contact length and high withdrawal speeds, the high surface temperatures cause the yield point to form on the draw pin. The draw pin may have a curved surface with a radius of, for example, 10 cm or even far higher. The draw pin is mounted stationarily and not for rotation, and its surface is contacted or looped by the yarn in part. Due to the high surface temperatures, the contact length and the contact force may be kept very small. This allows to lessen the wear of the draw pins. Furthermore, the frictional forces on the yarn are very small, so that damage to the yarn is prevented.

It should expressly be noted that the draw pin may also be replaced with a plate, which is contacted by the yarn.

The invention turns deliberately away from an "only" contactfree guidance of the yarn. In accordance with an embodiment wherein the surface temperature of the second heat treatment is above the melt point of the yarn, the heat transfer occurs in the first stage by contact, which is made such as to result in only small frictional forces on the yarn. In particular, the first stage of the heat treatment may occur with the use of a heated godet, which withdraws the yarn from the spinneret. This godet is arranged at a location, in which the freshly spun yarn is again substantially cooled (about 40° C.). This godet may be heated to a temperature from 70 to 120° C. A subsequent draw roll withdraws the yarn from the first godet under such a yarn tension, that the yield point forms in the yarn directly upon its leaving the godet. Alternatively, a draw pin that is heated from the inside or a heated plate may be used in the place of the godet or withdrawal roll. The contact length on the draw pin may be so small that the developing frictional forces are just adequate for a plastic flow to occur for the first time on the draw pin and, accordingly, for the formation of a yield point. Thus, the draw pin acts as a brake surface, similar to that disclosed in DE 38 23 337. In the second stage, however, the yarn is advanced substantially without contact, i.e., it is guided very precisely at a close distance from a heating surface, which is heated to a temperature from 350 to 550° C. The spacing between the yarn and the heating surface ranges from 0.5 to 3.5 mm, so that the yarn is suddenly heated when entering into the heating zone.

The yarn is guided by yarn guides, which provide, on the one hand, a smooth run of the yarn and, on the other hand, a precise distance from the heating surface.

In a third stage, the yarn may then be heated in a different embodiment, likewise without contact and at a close distance from a further heating surface, which is heated to a temperature from 300 to 500° C.

In another embodiment, the drawing occurs between two godets, with the first godet being unheated, and with the first heat treatment occurring downstream of the first godet by means of a stationary draw pin which is partially looped or at least contacted by the yarn. This permits a very accurate adjustment of the draw ratio. Even at withdrawal speeds higher than 5,000 m/min, the draw pin ensures the formation of the yield point.

Another embodiment provides for the first heat treatment to occur downstream of the first godet by means of a heated plate, along which the yarn is guided without contact. This has the advantage that larger looping angles allow to produce higher yarn tensions.

A further embodiment provides for the drawing to start in the spin zone, with the withdrawal speed of the takeup being above 5,000 m/min. This has the advantage of utilizing the entrained spinning heat already in the first stage of the heat treatment. In this instance, it is not necessary to guide the yarn over a curved heating surface. As a result, withdrawal speeds can be reached in a range from 6,000 to 7,500 m/min.

The drawing may occur by means of a godet, which withdraws the freshly spun yarn directly from the spinneret at a speed greater than 3,500 m/min, and wherein the first heat treatment is provided by means of a stationary draw pin which is partially looped or at least contacted by the yarn. This results in a very simple process control.

The first heat treatment may be provided by a draw pin which is arranged within an elongate heating surface and adjacent the yarn inlet end thereof, and with the temperature of the heating surface being greater than the melt point of the yarn. This provides the advantage that the yarn forms, under little draw tension, a very precisely localized yield point, and undergoes a preferred structural change already in the first drawing stage as a result of its sudden heating.

The method may be applied to all commonly used polymer types. For the physical properties of yarns, it may be advantageous that same are spun from a formulation of different polymers. For example, it is known that the addition of up to 5% PBT (polybutylene terephthalate) to PET improves the spinnability and the elastic properties of the fibers.

Preferably, this method may be applied to process polypropylenes with a very narrow molecular weight distribution in a range smaller than 3, in particular types produced on the basis of metallocenes.

The apparatus is characterized in that a very short heater may be used, which has, however, due to its configuration, the advantage that it permits in the yarn a very purposeful temperature control, which is adapted to the speed of the yarn, and a very uniform heating over the length of the yarn. The sudden supply. of heat upon the start of the plastic flow prevents an interference with the crystalline structure and, thus, permits an optimal orientation of the yarn molecules.

The shocklike supply of heat in the first stage of the heating results in reaching the yield point suddenly, and it also reduces the length and force of contact.

A particular embodiment of the heater takes the form of an elongate, U-shaped body having a longitudinal heating groove, and guides for guiding the advancing yearn along the groove without contacting the groove walls. This provides the advantage that it is simple to operate, in particular that it facilitates the threading of the yarn. Likewise, it is easy to monitor.

The elongate heater as described above may comprise a plurality of body segments positioned in an end to end relationship. Also, the body segments may be positioned with respect to each other so as to define an obtuse angle when viewed in side elevation. This ensures a smooth yarn guidance and, further, permits a temperature control that may be adapted to particular requirements. As a result, strength, elongation, and shrinkage tendency of the yarn can largely be influenced and adjusted to desired values. Also, short guide elements may be distributed along the heated surface to establish the yarn path relative to the heated surface and to smoothen the yarn path.

In another specific embodiment, the heater of the first treatment may comprise a heated draw pin which is partially looped by the yarn, with the surface of the draw pin having a temperature above the melt point of the yarn, preferably greater than 150° C. above the melt point. Alternatively, the first heat treatment may be provided by a heated plate along which the yarn advances without contacting the same, and with the temperature of the plate being above the melt point of the yarn, by at least 150° C. These embodiments provide a simple configuration from the viewpoint of mechanical engineering. The looping of the yarn on the draw pin may be adjusted very simply by positioning the draw pin, so that with regard to the temperature of the draw pin, the yarn tension is increased so much that a yield point forms on the draw pin. This embodiment may also be operated without withdrawal roll, which is simple with respect to the machine construction, on the one hand, but also permits, on the other hand, to already utilize for the formation of the yield point the heat which is entrained in the yarn from the spin zone.

The draw zone may be arranged between a withdrawal godet and a downstream drawing godet. This permits very far reaching possibilities for adjusting the draw ratio and the resulting orientation and other properties of the yarn.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
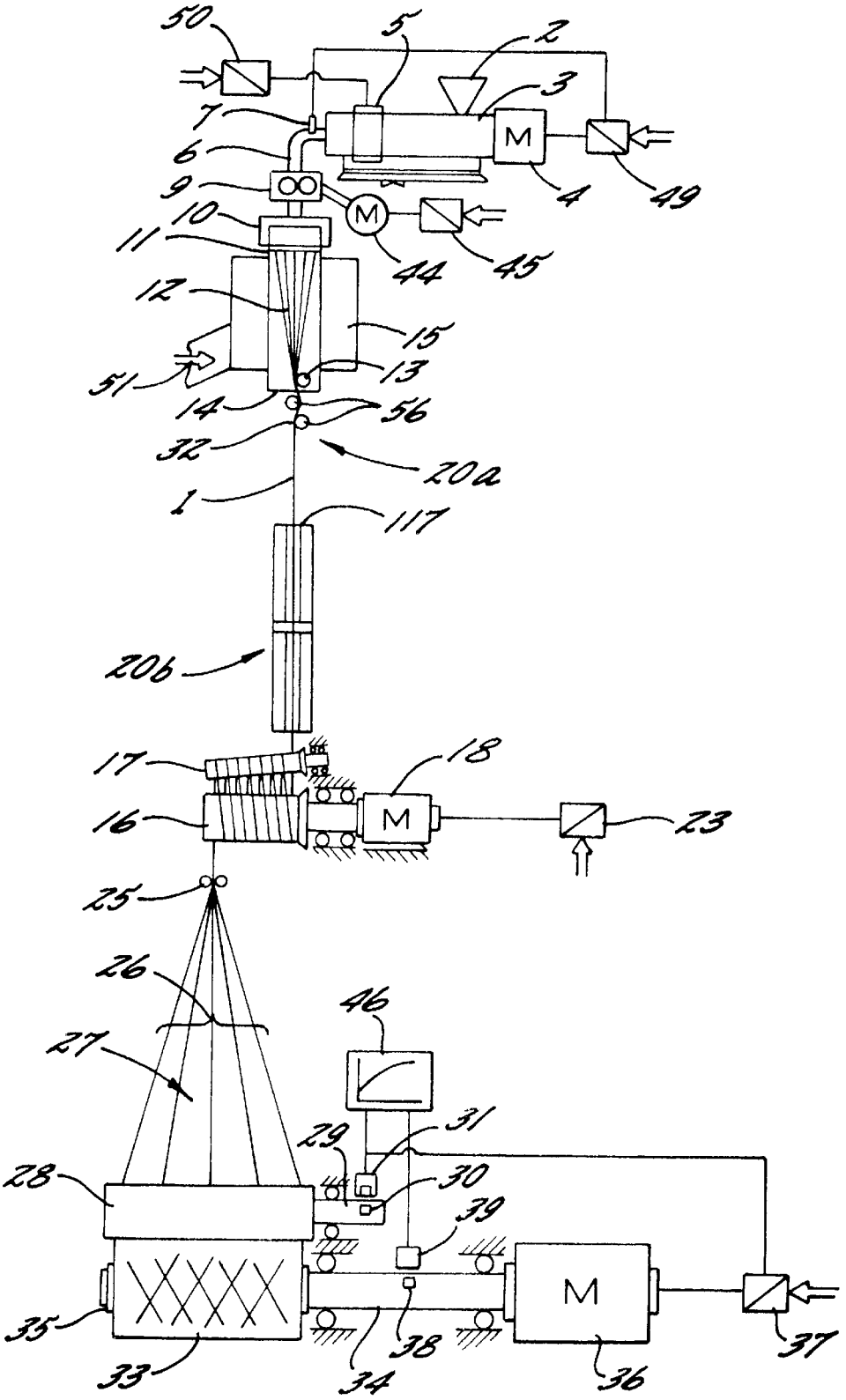
FIG. 1 is a schematic view of a spin process and apparatus which embodies the present invention.
Figure 2:
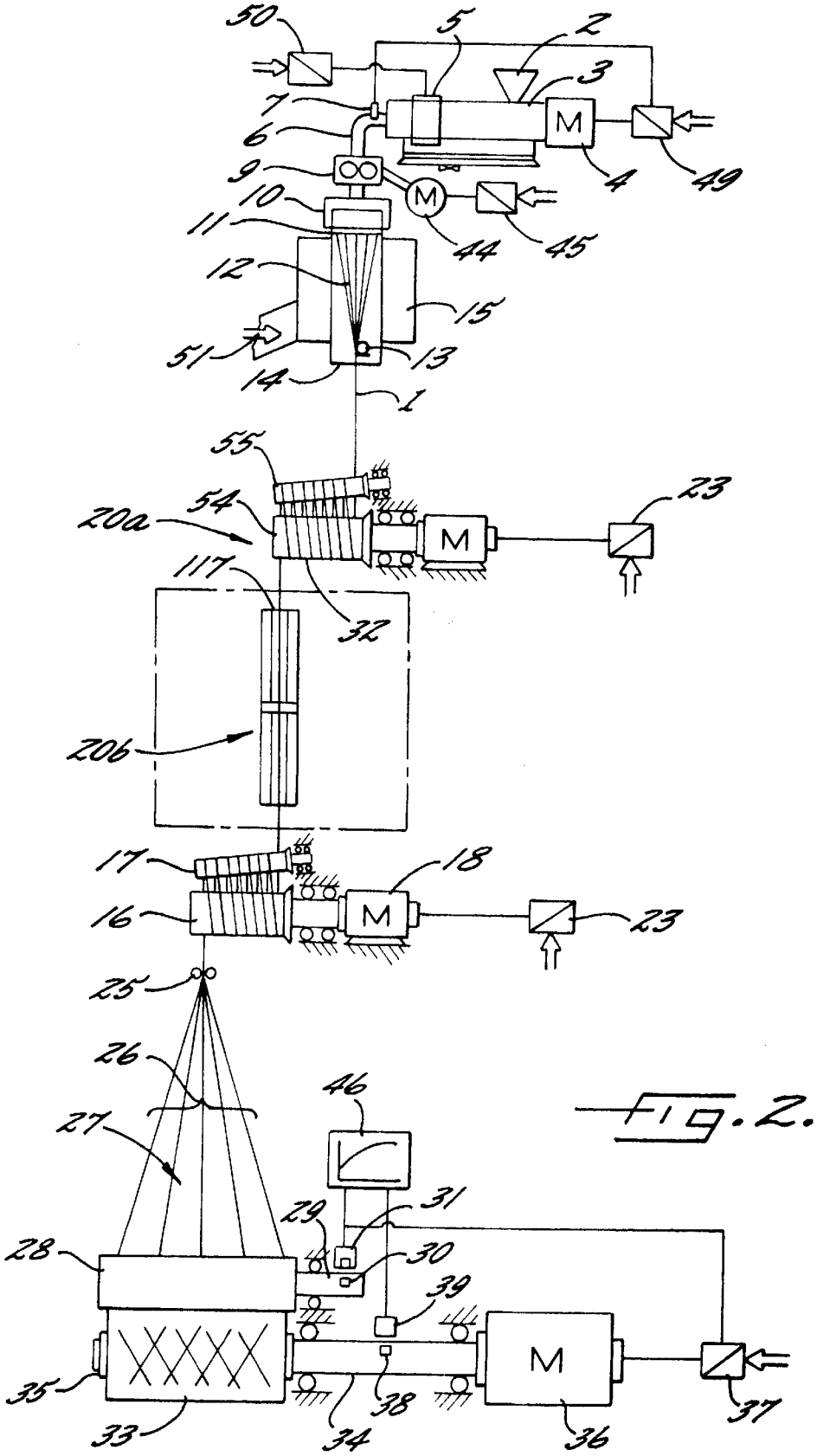
FIG. 2 illustrates a modification of the method and apparatus.

FIGS. 1 and 2 illustrate a yarn spinning method and apparatus wherein a yarn 1 is spun from a thermoplastic material. The thermoplastic material is supplied through a feed hopper 2 to an extruder 3. The extruder 3 is driven by a motor 4, which is controlled by a motor control unit 49. In extruder 3, the thermoplastic material is melted. The work of deformation (shearing energy) which is applied by the extruder to the material assists in the melting process on the one hand. In addition, a heater 5, for example, in the form of a resistance heater, is provided, which is controlled by a heating control unit 50. Through a melt line 6, which accommodates a pressure sensor 7 for measuring the melt pressure for a pressure-speed control of the extruder, the melt reaches a gear pump 9, which is driven by a pump motor 44. The pump motor is controlled by a pump control unit 45 such as to permit a very fine adjustment of the pump speed. The pump 9 delivers the melt flow to a heated spin box 10 which mounts on its underside a spinneret 11. From spinneret 11, the melt emerges in the form of a web of fine filaments 12. The web of filaments 12 advances through a cooling shaft 14. In cooling shaft 14, an air flow 51 is directed transversely or radially toward the web of filaments 12 from a housing 15, thereby cooling the filaments.

At the end of cooling shaft 14, a spin finish applicator roll 13 or an applicator pin combines the web of filaments to form a yarn 1 and applies to the yarn a liquid spin finish.

Referring now only to the embodiment of FIG. 1, the yarn is withdrawn from cooling shaft 14 and from spinneret 11 by a godet 16. The yarn loops about godet 16 several times. To this end, a guide roll 17 which is axially inclined relative to godet 16 is used. The guide roll 17 is freely rotatable. Godet 16 is driven by a godet motor 18 and a frequency changer 23 at a preadjustable speed. This speed is by a multiple higher than the natural exit speed of filaments 12 from spinneret 11, and it is higher than the filament speed after solidification by the air flow.

Referring now only to the embodiment of FIG. 2, the yarn is withdrawn from cooling shaft 14 and spinneret 11 by a godet 54. The yarn loops about godet 54 several times. To this end, a guide roll 55 which is axially inclined relative to godet 54 is used. The guide roll 55 is freely rotatable. The godet 54 is driven by a motor at a preadjustable speed. This withdrawal speed is by a multiple higher than the natural exit speed of the filaments 12 from the spinneret. From godet 54, the yarn advances through a heater **20*b* to a further godet 16, also referred to as draw roll in the present embodiment. The draw roll 16 is driven at a higher speed than the aforesaid godet 54. As a result, the yarn is drawn between the two godets 54 and 16**.

Referring now again to both embodiments, from draw roll 16 of FIG. 2 or draw roll 16 of FIG. 1, the yarn 1 advances to a so-called "apex yarn guide" 25 and thence into a traversing triangle 26. Not shown in the Figures is a yarn traversing mechanism 27, which may, for example, comprise counterrotating blades which reciprocate the yarn 1 over the length of a package 33. In so doing, the yarn loops, downstream of the traversing mechanism 27, about a contact roll 28. The roll 28 rests against the surface of a package 33, which is formed on a tube 35. The tube 35 is clamped on a winding spindle 34, which is driven by a spindle motor 36 and a spindle control unit 37 such that the surface speed of the package 33 remains constant. To this end, the speed of contact roll 28 which rotates freely about a shaft 29 is scanned as a controlled variable by means of a ferromagnetic insert 30 and a magnetic pulse generator 31. A comparator 46 may be provided for comparing the rotational speeds of the spindle 34 and shaft 29.

It should be remarked that the yarn traversing mechanism 27 may also be a standard cross-spiralled roll with a traversing yarn guide reciprocating in a groove over the width of the traverse.

In FIG. 1, the diameter or a value derived therefrom is continuously measured as parameter of the condition of the package 33. For measuring the diameter, the speed of spindle 34 and the speed of contact roll 28 resting against the surface of the package are measured. To this end, use is made of ferromagnetic inserts 30, 38 both in spindle 34 and in contact roll 28, as well as corresponding pulse generators 31, 39. Whereas the speed of the contact roll 28 is used simultaneously as a control variable for the adjustment of spindle motor 36 via spindle control unit 37, the speed of spindle 34, which is not described in more detail, is used to control the yarn traversing mechanism 27.

Figure 4:
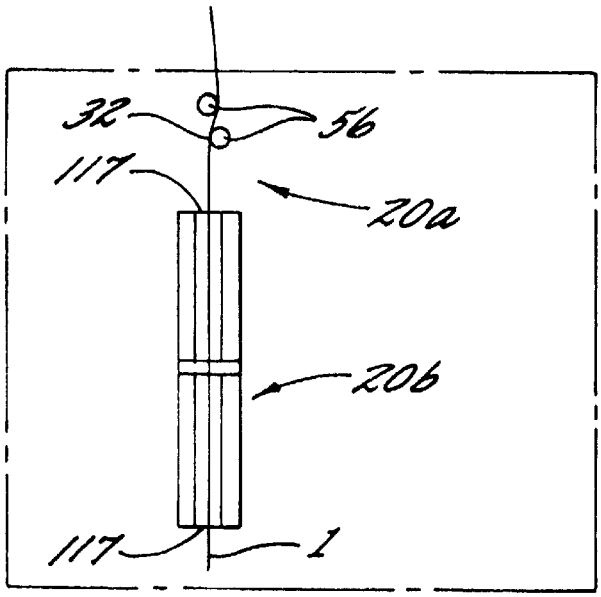
FIG. 4 schematically illustrates a modification of the draw zone and its apparatus.
Figure 5:
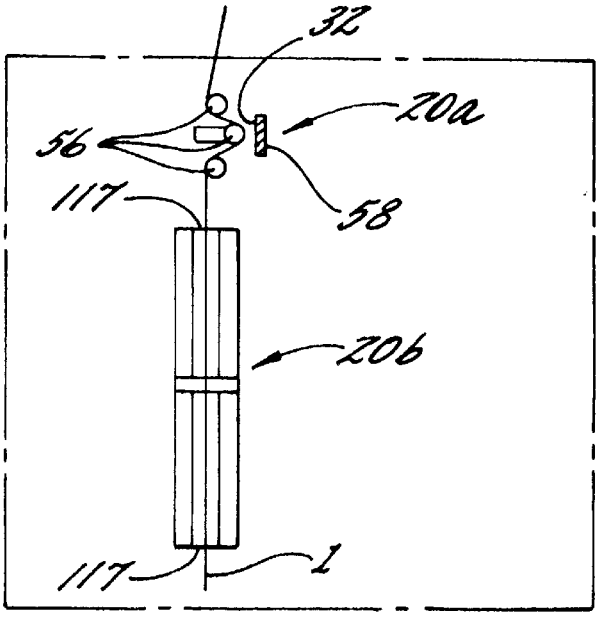
FIG. 5 schematically illustrates a further modification of the draw zone and apparatus.

As shown in the embodiment of FIG. 1, draw pins 56 and heater **20*b* are arranged between cooling shaft 14 and godet 16. The last of draw pins 56 has a heated surface 32, so as to define a first heater 20*a*, and so that the heater 20*b* defines a second or downstream heater. Preferably, the draw pins are not rotatable and they are mounted stationarily. They are partially looped by the yarn. By the adjustment of the first draw pin perpendicularly to the yarn path, the looping angle and, thus, the contact length on the surfaces of each draw pin may be reduced or enlarged as desired. In an arrangement comprising three draw pins (FIG. 5), it is preferred to adjust the intermediate draw pin. In FIGS. 1, 4, and 5**, the illustration of the offset is exaggerated. In reality, a small offset will suffice. At least one of the draw pins, as aforesaid, preferably the last one, is heated. The temperature, to which the yarn is heated, is higher than the glass transition temperature of the yarn, which is 55° C. and less than 120° C. for polyester.

At a surface temperature of the heating surface 32 of heated draw pin 56, which is above the melt point of the yarn material, withdrawal speeds higher than 5,000 m/min are reached. In this instance, the contact lengths on draw pins 56 are kept very short.

In the embodiment of FIG. 2, the heater 20b is positioned between withdrawal roll 54 and draw roll 16. In this embodiment, the surface 32 of withdrawal roll 54 is heated, so as to define a first heater **20*a*, and so that the yield point of the yarn forms directly downstream of or on the godet. For a further heat treatment, the yarn advances through the heater 20*b***, which may be described as a second heater.

FIG. 4 illustrates a modification of the embodiment of FIG. 2. In this embodiment, the withdrawal roll 54 is unheated. Instead, upstream of heater **20*b*, draw pins 56 are arranged, of which at least one has a heated surface 32, so as to define the first heater 20*a*. Otherwise, the configuration and temperature control of these draw pins corresponds to those of the draw pins, as have been described with reference to FIG. 1**.

An advantageous further development of the arrangement of FIG. 4 is realized, when the draw pins 56 are arranged in the yarn inlet region of the second heater **20*b*. In this instance, the yield point of the yarn will form directly downstream of the last draw pin 56**, so that drawing and setting occur in the directly following heat treatment.

FIG. 5 shows likewise a modification of the embodiment of FIG. 2. The withdrawal roll 54 is unheated. Upstream of heater **20*b*, unheated draw pins 56 are arranged. Opposite to the looping side of the intermediate draw pin is a heated plate 58, which defines the first heater 20*a***, so that both the yarn and, indirectly, the draw pins are heated.

In this embodiment, the method may be modified to the extent that the draw pins 56 are omitted. In this instance, the yarn advances barely contacting, or even without contacting the heated plate 58.

In the embodiments of FIGS. 4 and 5, each of which replaces the boxed-in portion in FIG. 2, the draw pins and the second heater 20*b* are arranged between the withdrawal roll 54 and the draw roll 16.

In the embodiment of FIG. 2, the withdrawal roll 54 is heated to a temperature from 70 to 120° C.

In both cases, the withdrawal roll 16 may also be heated to a temperature of about 150°±40° C., so as to achieve a shrinkage and heat setting of the yarn. However, this is not subject matter of the invention.

Figure 6:
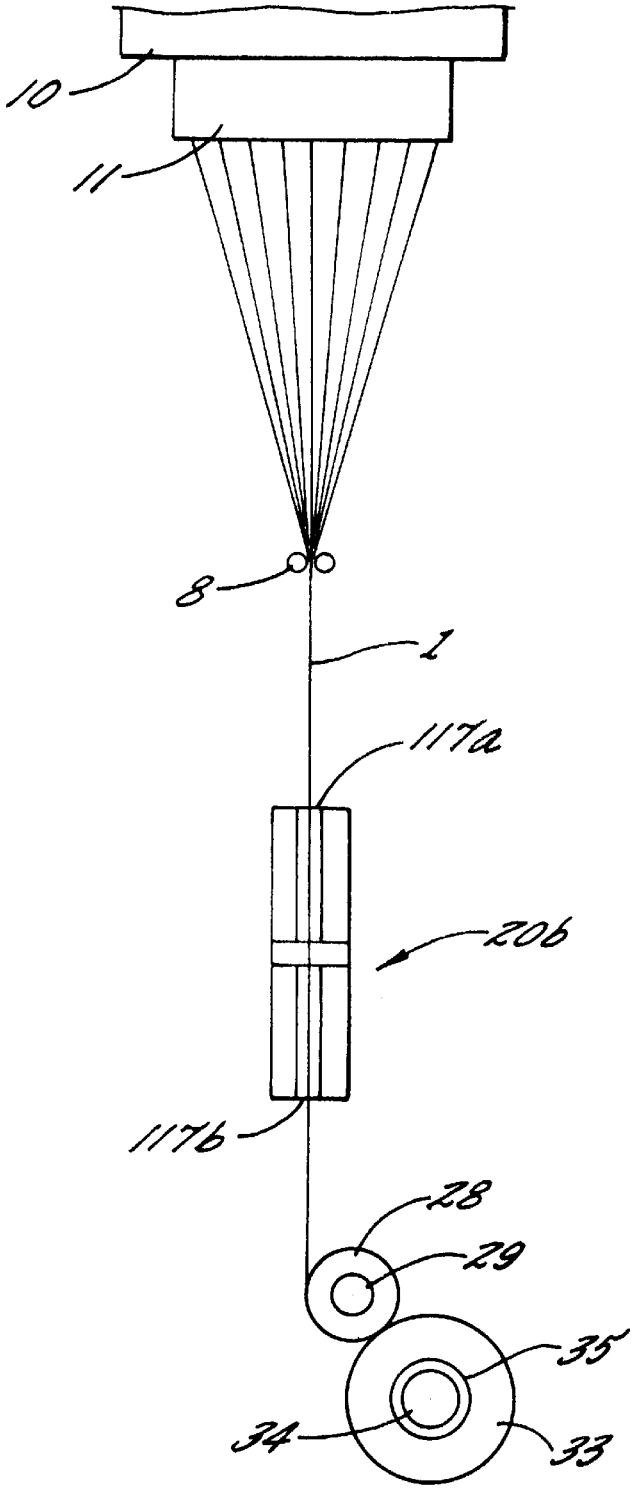
FIG. 6 illustrates an embodiment of the method and its apparatus of the present invention and which does not employ godets.

In the embodiment illustrated in FIG. 6, the yarn is withdrawn directly, without godets, at a speed greater than 5,000 m/min directly by the takeup unit, which as illustrated comprises a contact roll 28 and a package 33. A drawing starts initially in the spin zone. A first stage of the heat treatment is formed by entrained spinning heat, and the yarn need not be guided over a curved surface. Subsequently, the yarn advances through an eyelet or yarn guide 8 to a second stage of the heat treatment by means of heater 20*b*. The heat treatment occurs in that the yarn 1 is guided substantially over a heating surface 117*a*, 117*b*. The heating surface 117*a*, 117*b* has a surface temperature, which is above the melt point of the yarn material. After drawing, the yarn is wound directly onto the package 33. This modification allows withdrawal speeds in a range from 6,000 to 7,500 m/min to be reached.

The heater 20*b* may be constructed in two sections. Both sections have about the same length, namely from 300 to 500 mm, or they may be made deliberately shorter in the inlet region and longer in the following zones, so that the temperature in the inlet region can be exceeded considerably in comparison with the subsequent zones. The temperature is controlled such that in the inlet section, the surface temperature ranges from 450 to 550° C. and in the outlet section from 400 to 500° C. The yarn is guided at a small distance from the respective surface, for example a distance from about 0.5 to 3.5 mm.

Figure 3A:
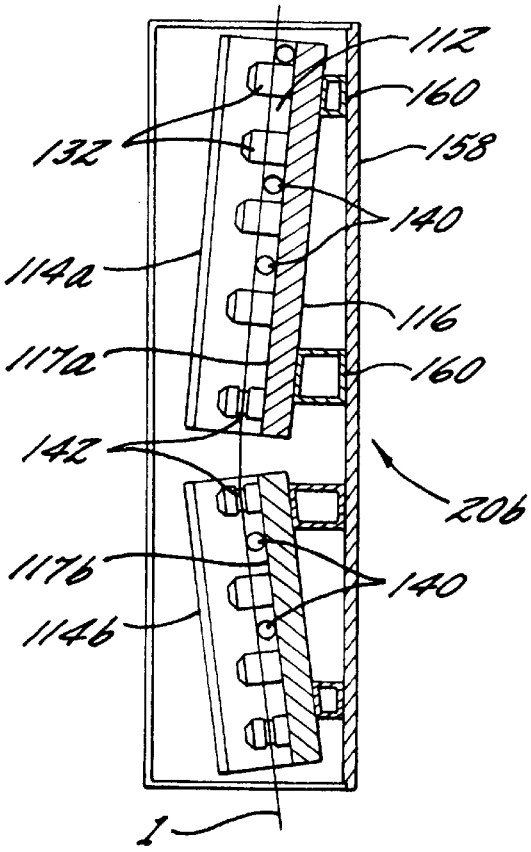
FIGS. 3*a*, 3*b*, and 3*c* are sectional side, sectional transverse, and front views, respectively, of a heater which may be used with the present invention.
Figure 3B:
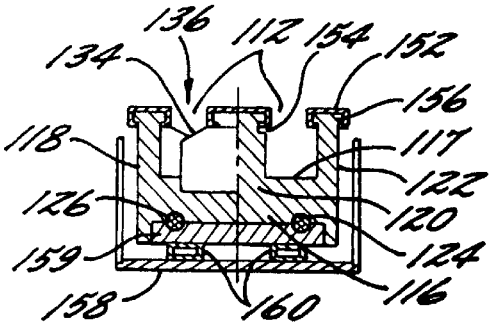
Figure 3C:
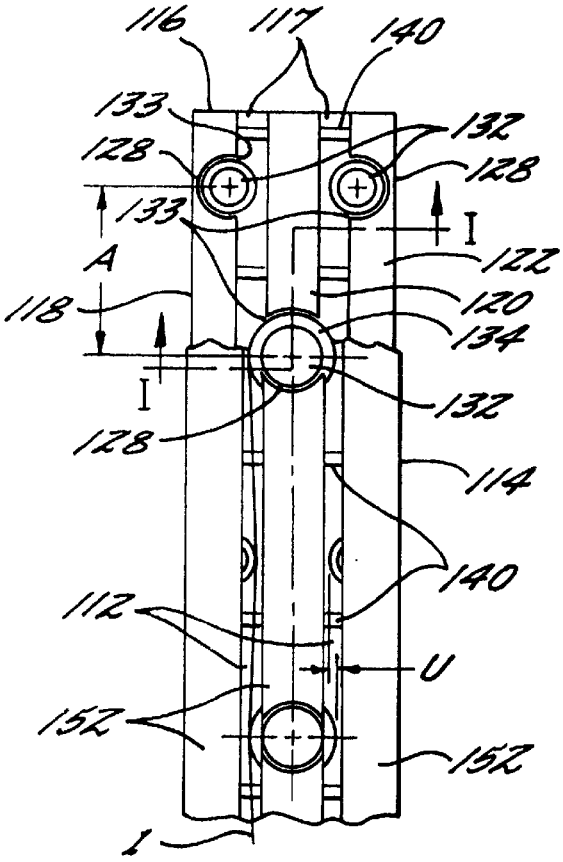

The heater 20*b*, is more particularly described with reference to FIGS. 3*a*–3*c*. As shown, the heater 20*b* may consist of a plurality of, in the present embodiment two, body segments 114*a* and 114*b*. The two body segments are of a different length, but otherwise have an identical cross sectional configuration. Such a bipartite arrangement may serve the purpose of heating heater 20*b* in different axial segments to a different temperature, so as to treat the yarn 1 in a heat profile that meets with its properties. This means, that more than the two shown segments may be used. Of special importance is that the angle, which the two heating segments 114*a*, 114*b* form with each other, is identically adjusted in each processing station of a spin-draw machine, so that all processing stations produce yarns of the same quality. To mount the two heating segments 114*a*, 114*b*, a mounting rail 158 is used, which has the length of both heating segments. The mounting rail has a U-shaped cross section. The heating segments 114*a*, 114*b* are attached with spacers 160 to the bottom of the mounting rail. As a result of the dimensioning of the spacers and their position relative to the heating segments 114*a*, 114*b*, the inclination of the heating segments is established with respect to the straight mounting rail 158. In this arrangement, the two heating segments are oppositely inclined relative to the mounting rail and, moreover, they form an obtuse angle with respect to each other. On the one hand, the mounting rail 158 is used to accurately mount the two heating segments. However, since the mounting rail 158 has a U-shaped profile, it also surrounds the two heating segments. Therefore, the mounting rail 158 is also used to equalize the temperature over the length and width of the heating segments.

Each of the heating segments 114*a*, 114*b* is provided with two longitudinal grooves 112, and each heating segment includes a substantially flat base portion 116 which defines an upper heating surface 117. Outer side walls 118, 122 are thus defined which lie on the outside of the longitudinal grooves, and a central wall 120 is defined which lies between the longitudinal grooves.

Inserted in walls 118, 120, 122 are recesses or bores 128. The recesses 128 arranged in central wall 120 are offset by the spacing A from the recesses 128 in side walls 118 and 122. The recesses have a circular-cylindrical shape. Each recess 128 in the outer walls 118, 122 is intersected by a longitudinal groove 112, and each recess 128 in the central wall 120 intersects both grooves 112. Thus the walls 118, 120, 122 and the yarn guides 132 form therebetween slots 133.

Each recess 128 accommodates a yarn guide 132, the cross sectional shape of which corresponds to the cross section of the recess both in size and shape. A portion of each yarn guide 132 extends in the groove 112 such that, on opposite sides of grooves 112, successively arranged yarn guides 132 extend by a certain dimension, beyond the walls 118, 120, 122.

Caps 152 are positioned on top of the walls 118,120,122. The side walls 118 and 122 are provided on their upper edge portions with a head 156, which is wider than the respective wall, note FIG. 3*b*. The central wall 120 is provided on its upper edge portion with retaining grooves 154. In cross sectional view, the caps 152 have a C-shaped profile, so that in the case of central wall 120 they extend into retaining grooves 154, or in the case of side walls 118, 122 they embrace wall head 156.

The yarn guides 132 are conically beveled on their ends facing away from the base portion 116, as is indicated at 134. As a result, the yarn guides 132 successively arranged in opposite walls 118 and 120, or 122 and 120 form a V-shape 136, as seen in FIG. 3*b*. The yarn 1 resting against the contact surfaces of the yarn guides then forms a zigzagged yarn path of travel along the groove.

It is possible to provide bar-shaped spacers 140, which bridge over the bottom of an axial groove 112, i.e., the heating surface 117*a*, 117*b*, and define the yarn path at a precise distance from the groove bottom. Alternatively or additionally, some or all yarn guides 132 may be provided with a peripheral guide edge, for example, a peripheral groove 142 (FIG. 3*a*), whose height from the bottom is adapted to the height of the yarn path that is predetermined by guide elements 140. In this manner, the yarn which is guided in the groove is guided in addition by the side edges of the groove. The peripheral grooves have the same depth over the circumference and, thus, are made concentric with yarn guides 132. However, it is also possible to provide the peripheral groove with a depth changing over the course of the circumference, for example, in that the groove bottom is cut in circular-cylindrical shape, but off-center relative to the yarn guides 132. This makes it possible to finely adjust the contact between yarn 1 and yarn guides 132 and define a zigzag yarn path by rotating the yarn guides. To this end, the yarn guides 132 may be rotated jointly and to a same extent, for example, by means of a linkage (not shown), to which they are connected.

The heater is preferably accommodated in an insulated box (not shown), in which it is embedded in a heat-insulating material, for example fiber glass. The insulated box may be provided with a flap, which permits the box to be opened for accessing the heater and threading the yarn.

Furthermore, the insulated box with its portions overlying the heater serves to axially position the yarn guides 132 in the rail 114. To this end, the insulated box is provided with slots, which align with the central plane and bevels 134 of the yarn guides 132 and permit a yarn 1 to be inserted for its treatment between yarn guides 132. On their side walls, the slots are provided with wear-resistant insulated sheets. Likewise accommodated, if need be, in the insulated box are the necessary electrical contacts for heating elements 124, 126.

The surfaces of the yarn guides which contact the yarn have a relatively large diameter. In contrast thereto, the zigzag line, along which the yarn advances as a result of an overlap U of successive yarn guides, has a relatively small amplitude with a relatively large spacing A between two adjacent yarn guides. This allows the looping angle, at which the yarn loops about the yarn guides or the contact surfaces formed thereon to be small, when added up.

In the illustrated embodiment, the heater **20*b* includes two parallel grooves 112 of like construction, and the heater has two channels below the grooves which accommodate the heating elements 124 and 126. The heating elements are clamped in place by a mounting plate 159 which extends over the entire length of the heater. To this end, the mounting plate is provided with grooves which enclose the heating elements 124, 126. By disengaging the mounting plate 159, the heating elements 124, 126** can easily be replaced.

The spacing between the yarn and heating surface 117 is very small and ranges from 0.5 to 5 mm. Preferably the upper value is no more than 3.5 mm, so as to realize a good heat transfer and an accurate, troublefree temperature control.

As a result of heating the heater **20*b* to a correspondingly high temperature of more than 350° C., a sudden heating occurs. At least in part, the yarn guides 132** may also be omitted or removed, should they exert a negative influence. However, the yarn guides contribute to a smoothing of the yarn path and heating the yarn by contact and, in addition, they exert only little friction on the yarn due to the small looping. However, their essence is the contactfree guidance in close vicinity to the heating surface which is heated to a high temperature.

In the drawings and the specification, there has been set forth preferred embodiments of the invention, and, although specific terms are employed, the terms are used in a generic and descriptive sense only and not for the purpose of limitation, the scope of the invention being set forth in the following claims.

We claim:

1. An apparatus for spinning a synthetic multi-filament yarn comprising means for extruding a polymeric melt to form a plurality of advancing filaments, and gathering the filaments to form an advancing yarn, means for drawing the advancing yarn as it advances through a drawing zone, heating means for heating the advancing yarn in the drawing zone and including a first heater over which the yarn is guided, and a second heater positioned downstream of the first heater, wherein said second heater includes an elongate heating surface and a plurality of guides, wherein said guides are positioned in a spaced apart relationship along the heating surface for guiding the advancing yarn in close distance to but at least substantially spaced from the heating surface, and means for heating said second heater to a temperature above the melt point temperature of the yarn, and a winder positioned downstream of the heating means for winding the advancing yarn into a package.

2. The apparatus as defined in claim 1 wherein the drawing means subjects the advancing yarn to a tension which is sufficient for the plastic deformation of the yarn during or immediately downstream of the first heater.

3. The apparatus as defined in claim 2 wherein said second heater comprises an elongate body of generally U-shaped cross sectional configuration so as to define at least one longitudinal heating groove, and wherein said guides guide the advancing yarn along the groove without substantial contact with the body.

4. The apparatus as defined in claim 3 wherein said elongate body comprises a plurality of body segments positioned in an end to end relationship.

5. The apparatus as defined in claim 4 wherein two of said body segments are positioned with respect to each other so as to define an obtuse angle when viewed in side elevation, and wherein the guides include guides arranged at the adjacent ends of the body segments for guiding the advancing yarn between the grooves of the body segments without substantial contact with the body segments.

6. The apparatus as defined in claim 3 wherein the first heater comprises a draw pin which is positioned to be engaged by the advancing yarn, and wherein the temperature of the draw pin is above the melt point of the yarn.

7. The apparatus as defined in claim 3 wherein the first heater comprises a heated plate which is positioned so as to be adjacent but spaced from the advancing yarn, and wherein the temperature of the heating plate is above the melt point of the yarn.

8. The apparatus as defined in claim 3 wherein the drawing zone is defined between a withdrawal godet and a draw godet, and wherein the first heater comprises a heating surface on said withdrawal godet.

9. The apparatus as defined in claim 3, wherein said guides are configured and positioned in a longitudinally and laterally spaced apart arrangement along the groove so as to impart a zigzagged path of travel to the advancing yarn.

* * * * *